US011903550B2

(12) United States Patent
Krebs

(10) Patent No.: US 11,903,550 B2
(45) Date of Patent: Feb. 20, 2024

(54) VACUUM CLEANER

(71) Applicant: BISSELL Inc., Grand Rapids, MI (US)

(72) Inventor: Alan J. Krebs, Pierson, MI (US)

(73) Assignee: BISSELL Inc., Grand Rapids, MI (US)

( * ) Notice: Subject to any disclaimer, the term of this patent is extended or adjusted under 35 U.S.C. 154(b) by 446 days.

(21) Appl. No.: 17/086,767

(22) Filed: Nov. 2, 2020

(65) Prior Publication Data

US 2021/0045598 A1 Feb. 18, 2021

Related U.S. Application Data

(63) Continuation of application No. 15/983,004, filed on May 17, 2018, now Pat. No. 10,820,764, which is a (Continued)

(51) Int. Cl.

| | |
|---|---|
| ***A47L 9/04*** | (2006.01) |
| ***A47L 5/30*** | (2006.01) |
| ***A47L 9/06*** | (2006.01) |
| ***A46B 13/00*** | (2006.01) |
| ***A47L 5/22*** | (2006.01) |
| ***A47L 5/36*** | (2006.01) |
| ***A47L 9/00*** | (2006.01) |

(Continued)

(52) U.S. Cl.

CPC ..... *A47L 9/0472* (2013.01); *A47L 5/225* (2013.01); *A47L 5/30* (2013.01); *A47L 5/362* (2013.01); *A47L 7/0014* (2013.01); *A47L 9/009* (2013.01); *A47L 9/0411* (2013.01); *A47L 9/0422* (2013.01); *A47L 9/0433* (2013.01); *A47L 9/0444* (2013.01); *A47L 9/0488* (2013.01); *A47L 9/0686* (2013.01); *A47L 9/104* (2013.01); *A47L 11/22* (2013.01); *A46B 13/001* (2013.01)

(58) Field of Classification Search

CPC ..... A47L 9/0472; A47L 5/225; A47L 5/30; A47L 5/362; A47L 7/0014; A47L 9/009; A47L 9/0411; A47L 9/0422; A47L 9/0433; A47L 9/0444; A47L 9/0488; A47L 9/0686; A47L 9/104; A47L 11/22; A46B 13/001

See application file for complete search history.

(56) References Cited

U.S. PATENT DOCUMENTS

| | | | |
|---|---|---|---|
| 1,677,533 | A | 7/1928 | Staehle |
| 2,220,224 | A | 11/1940 | Faber |

(Continued)

FOREIGN PATENT DOCUMENTS

| | | | |
|---|---|---|---|
| GB | 1392150 | A | 4/1975 |
| GB | 2213047 | A | 8/1989 |

(Continued)

*Primary Examiner* — David Redding

(74) *Attorney, Agent, or Firm* — McGarry Bair PC

(57) ABSTRACT

A vacuum cleaner includes a foot assembly having a suction inlet thereon, a suction source in fluid communication with the suction inlet to produce a working airflow there through, and a dirt container in fluid communication with the suction inlet and suction source. The foot assembly further includes a body defined by a central portion and a pair of extension arms, a rotatable agitator on each extension arm, and a drive assembly configured to counter-rotate the agitators. The counter-rotating agitators are operable to cooperate with the suction source to direct dust and debris towards the suction inlet.

20 Claims, 12 Drawing Sheets

Related U.S. Application Data continuation of application No. 15/621,441, filed on Jun. 13, 2017, now Pat. No. 9,993,127, which is a continuation of application No. 14/732,185, filed on Jun. 5, 2015, now Pat. No. 9,706,888, which is a continuation of application No. 13/287,615, filed on Nov. 2, 2011, now Pat. No. 9,072,415.

(60) Provisional application No. 61/410,660, filed on Nov. 5, 2010.

(51) Int. Cl.

| | |
|---|---|
| ***A47L 11/22*** | (2006.01) |
| ***A47L 7/00*** | (2006.01) |
| ***A47L 9/10*** | (2006.01) |

(56) References Cited

U.S. PATENT DOCUMENTS

| | | | | |
|---|---|---|---|---|
| 2,616,118 | A * | 11/1952 | Meyerhoefer | A47L 9/0666 15/396 |
| 2,946,080 | A | 7/1960 | Burch | |
| 3,101,505 | A | 8/1963 | Belicka et al. | |
| 3,314,099 | A | 4/1967 | Otto | |
| 3,574,880 | A | 4/1971 | Butzen | |
| 3,597,787 | A | 8/1971 | Rosendall | |
| 4,512,057 | A | 4/1985 | Laing et al. | |
| 5,463,791 | A | 11/1995 | Roden | |
| 5,784,754 | A | 7/1998 | Roden et al. | |
| 6,571,423 | B1 | 6/2003 | Lijzenga et al. | |
| 6,792,648 | B2 | 9/2004 | Lee | |
| 6,842,941 | B2 | 1/2005 | Lee | |
| 7,334,291 | B2 | 2/2008 | Song et al. | |
| 7,549,190 | B2 | 6/2009 | Oh et al. | |
| 7,578,020 | B2 | 8/2009 | Jaworski et al. | |
| 7,841,039 | B1 * | 11/2010 | Squire | A47L 13/44 15/228 |
| 8,832,902 | B2 | 9/2014 | Kim et al. | |
| 9,706,888 | B2 | 7/2017 | Krebs | |
| 2003/0221281 | A1 | 12/2003 | Oh | |
| 2004/0148731 | A1 | 8/2004 | Damman et al. | |
| 2007/0157422 | A1 | 7/2007 | Oh et al. | |
| 2008/0172822 | A1 | 7/2008 | Oh et al. | |
| 2012/0144619 | A1 | 6/2012 | Forbes et al. | |

FOREIGN PATENT DOCUMENTS

| | | | |
|---|---|---|---|
| GB | 2435819 | A * | 9/2007 |
| JP | 2000342498 | A | 12/2000 |
| JP | 2003038402 | A | 2/2003 |
| WO | 200074549 | A2 | 12/2000 |
| WO | 2006032991 | A2 | 3/2006 |
| WO | 2009039622 | A2 | 4/2009 |

* cited by examiner

VACUUM CLEANER

CROSS-REFERENCE TO RELATED APPLICATIONS

This application is a continuation of U.S. patent application Ser. No. 15/983,004, filed May 17, 2018, now U.S. Pat. No. 10,820,764, issued Nov. 3, 2020, which is a continuation of U.S. patent application Ser. No. 15/621,441, filed Jun. 13, 2017, now U.S. Pat. No. 9,993,127, issued Jun. 12, 2018. which is a continuation of U.S. patent application Ser. No. 14/732,185, filed Jun. 5, 2015, now U.S. Pat. No. 9,706,888, issued Jul. 18, 2017, which is a continuation of U.S. patent application Ser. No. 13/287,615, filed Nov. 2, 2011, now U.S. Pat. No. 9,072,415, issued Jul. 7, 2015, which claims the benefit of U.S. Provisional Patent Application No. 61/410,660, filed Nov. 5, 2010, all of which are incorporated herein by reference in their entirety.

BACKGROUND

Vacuum cleaners can comprise one or more agitators rotatably mounted onto a foot portion of a vacuum cleaner to dislodge or sweep dirt on the surface being cleaned. The vacuum cleaner can further comprise a suction source fluidly connected to an upstream aperture disposed near the one or more brushes to ingest the dirt into a working air flow that is fluidly connected to a downstream filtration system. The filtration system is configured to separate the entrained dirt from the working air flow and convey the dirt into a removable dirt cup or a porous filter bag for later disposal.

Some known agitator mechanisms on vacuum cleaners comprise a cylindrical, transversely oriented brush assembly rotatably mounted within a suction aperture that spans the width of the vacuum cleaner foot. Such agitators are typically configured to dislodge dirt and hair from the cleaning surface and are positioned near the suction aperture for ingesting and transporting dirt through the working air flow and collecting it in a conventional manner.

BRIEF DESCRIPTION

An aspect of the present disclosure relates to a surface cleaning apparatus, including a housing, at least one agitator located on the housing in juxtaposition with the surface to be cleaned, the at least one agitator adapted to be dampened, a suction inlet, a suction source to produce a working airflow, a dirt cup in fluid communication with the suction inlet, a dirt inlet ramp forms a bottom wall of a dirt path from the suction inlet to a dirt ramp outlet and the dirt ramp outlet is fluidly coupled with the dirt cup and whereby a user can operate the surface cleaning apparatus to provide a manual damp mopping by manipulating the surface cleaning apparatus over the surface being cleaned without activating the suction source. surface cleaning apparatus, including a housing mounted to a handle or wand assembly, a suction source to produce a working airflow, a filtration system to remove debris from the working airflow generated by the suction source, a suction inlet, a dirt container positioned in at least one of the handle, wand or housing, a first agitator located on the housing in juxtaposition with the surface to be cleaned, a working air conduit extending from the suction inlet and the dirt container, wherein, when the suction source is active, the suction source draws debris through the suction inlet, along the working air conduit for collection into the dirt container, wherein a portion of the working air conduit forms an intermediate collection chamber, the intermediate collection chamber being removable from a stored position in the housing, wherein when the suction source is not active, manual movement of the housing over the surface being cleaned rotates the first agitator and transports debris removed from the surface being cleaned by the first agitator into the suction inlet and into the intermediate collection chamber whereby a user can operate the surface cleaning apparatus manually by manipulating the vacuum cleaner over the surface being cleaned without activating the suction source.

DETAILED DESCRIPTION

Figure 12:
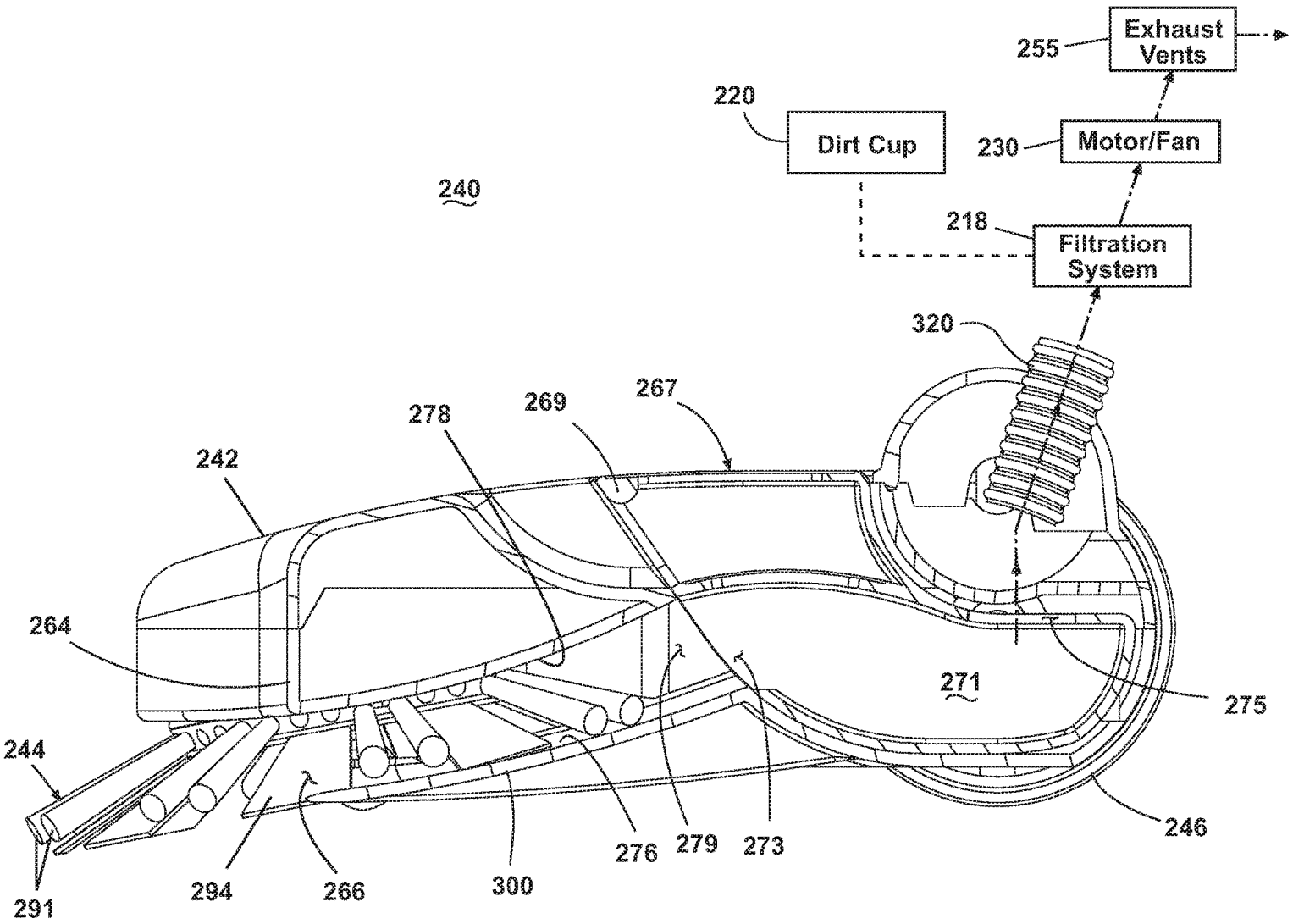
FIG. 12 is a partial section view of the foot assembly of FIG. 9 taken along line 12-12 with certain components shown in schematic form.

Aspects of the present disclosure relate generally to the foot portion of an upright, stick, or canister vacuum cleaner 10. More specifically, referring to FIGS. 1 and 2, aspects of the present disclosure relate to a foot assembly 40 including a foot housing 41 adapted to rotatably receive two counter-rotating agitators 44. The counter-rotating agitators 44 are oriented along generally vertical axes relative to the surface to be cleaned, which can include rotational axes that are canted or angled slightly relative to vertical so that a portion of the agitator engages the surface to be cleaned more than another. For example the rotational axes can be canted forwardly so that the forward most portion of the counter-rotating agitators 44 engages the surface to be cleaned whereas the rearward most portion engages the surface to be cleaned to a lesser degree, or is raised off the surface to be cleaned (FIG. 12). The counter-rotating agitators 44 are adapted to dislodge or sweep dirt residing outside a suction path of the cleaner 10 inwardly towards a centrally located suction aperture or inlet 52 within the foot housing 41. In one aspect, the vacuum cleaner 10 has a vacuum suction aperture that is narrower than the width of the vacuum cleaner foot housing 41, thus forming a focused suction area. In another aspect, the outer perimeter of the two counter-rotating agitators 44 extends beyond the width of the foot housing 41. In yet another aspect the vacuum cleaner is configured for improved energy efficiency.

Figure 1:
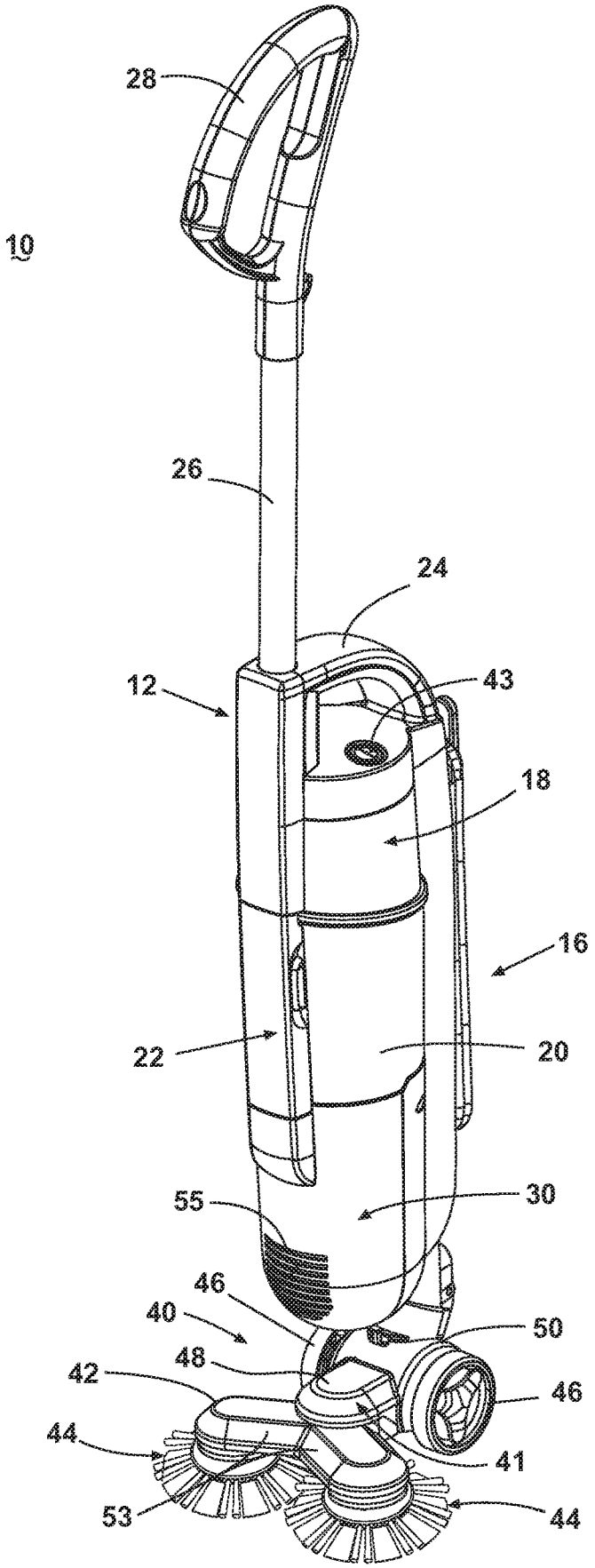
FIG. 1 is a front perspective view of a first example of a vacuum cleaner according to the present disclosure with a foot assembly including counter-rotating agitators.

For purposes of description related to the figures, the terms "upper," "lower," "right," "left," "rear," "front," "vertical," "horizontal," and derivatives thereof shall relate to the disclosure as oriented in FIG. 1 from the perspective of a user behind the vacuum cleaner, which defines the rear of the vacuum cleaner. However, it is to be understood that the disclosure can assume various alternative orientations, except where expressly specified to the contrary. It is also to be understood that the specific devices and processes illustrated in the attached drawings, and described in the following specification are simply exemplary examples of the inventive concepts defined in the appended claims. Hence, specific dimensions and other physical characteristics relating to the examples disclosed herein are not to be considered as limiting, unless the claims expressly state otherwise.

FIG. 1 is a front perspective view of a first example of a vacuum cleaner 10 with a foot assembly 40 including counter-rotating agitators 44 oriented along generally vertical axes. The vacuum cleaner 10 includes an upright handle assembly 12 pivotally mounted to a foot assembly 40 via a swivel joint (not shown). The upright handle assembly 12 includes a main body 16 housing a motor/fan assembly 30 for generating a working airflow, a filtration system 18 for separating dirt from a dirt-laden airflow and a removable dirt cup 20 for receiving and collecting the separated dirt from the filtration system 18. The dirt cup 20 can further include a latch mechanism 22 for selectively latching the dirt cup 20 to the main body 16. The main body 16 also has a first hand grip 24 provided on an upper surface of the main body 16 that can be used for lifting the entire vacuum cleaner 10. A handle 26 extends upwardly from the first hand grip 24 and is provided with a second hand grip 28 at one end that can be used for maneuvering the vacuum cleaner 10 over a surface to be cleaned.

The upright handle assembly 12 is pivotally mounted to the foot assembly 40. A conventional detent mechanism (not shown) can be configured to selectively engage and lock the upright handle assembly 12 in an upright position relative to the foot assembly 40. A user can disengage the detent mechanism to recline the upright handle assembly 12 during use as is commonly known in the art.

A suction source includes the conventional motor/fan assembly 30 mounted within a lower portion of the main body 16 that can be selectively energized via a conventional power switch 43. The motor/fan assembly 30 is configured to generate a working airflow through a working airflow path and is in fluid communication with the filtration system 18, which separates dirt from the dirt laden airflow. The filtration system 18 can be any variety of known types including, but not limited to, a conventional filter bag or at least one cyclone separator. Furthermore, the motor/fan assembly 30 can be located in the foot assembly 40 as well as the upright handle assembly 12, or in a conventional canister vacuum cleaner housing without departing from the scope of this disclosure. Additionally, the motor/fan assembly 30 can be located either downstream or upstream from the filtration system 18.

Referring to FIG. 1, the dirt cup 20 is in fluid communication with the filtration system 18 and is configured to collect the dirt separated from the dirt laden airflow by the filtration system 18. To empty the dirt cup 20, a user can actuate the latch 22 to release the dirt cup 20 from the main body 16 to empty the dirt. After the dirt is emptied, the dirt cup 20 can be reinstalled and secured to the main body 16 via the latch 22.

The foot assembly 40 includes a rear housing section 50 adapted to rotatably receive opposed rear wheels 46 on either side thereof. The foot assembly 40 further includes a central housing section 48 disposed forwardly of the rear housing section 50. As will be discussed in conjunction with FIG. 3, the central housing section 48 encloses an agitator drive motor 70 for driving the counter-rotating agitators 44. An agitator extension housing section 42 extends forwardly from the central housing section 48. The agitator extension housing section 42 includes a pair of diverging arms 53 that extend outwardly from an apex to form a V-shaped structure. The two counter-rotating agitators 44 are rotatably mounted beneath a distal end of each diverging arm 53 of the agitator extension housing section 42. The two counter-rotating agitators 44 are sized and configured so that at least a portion of the agitators 44 extend beyond the outer edge of the agitator extension housing section 42. The main body 16 is pivotally mounted to the rear housing section 50. A flexible conduit (not shown) extends from within the rear housing section 50 into the main body 16 and fluidly connects a suction opening or aperture 52 (FIG. 2) in the foot assembly 40 to the working airflow path in the main body 16. The counter-rotating agitators 44 can be any cleaning implement or combination of cleaning implements configured to sweep, brush, dust, buff, and/or mop the surface being cleaned.

Figure 2:
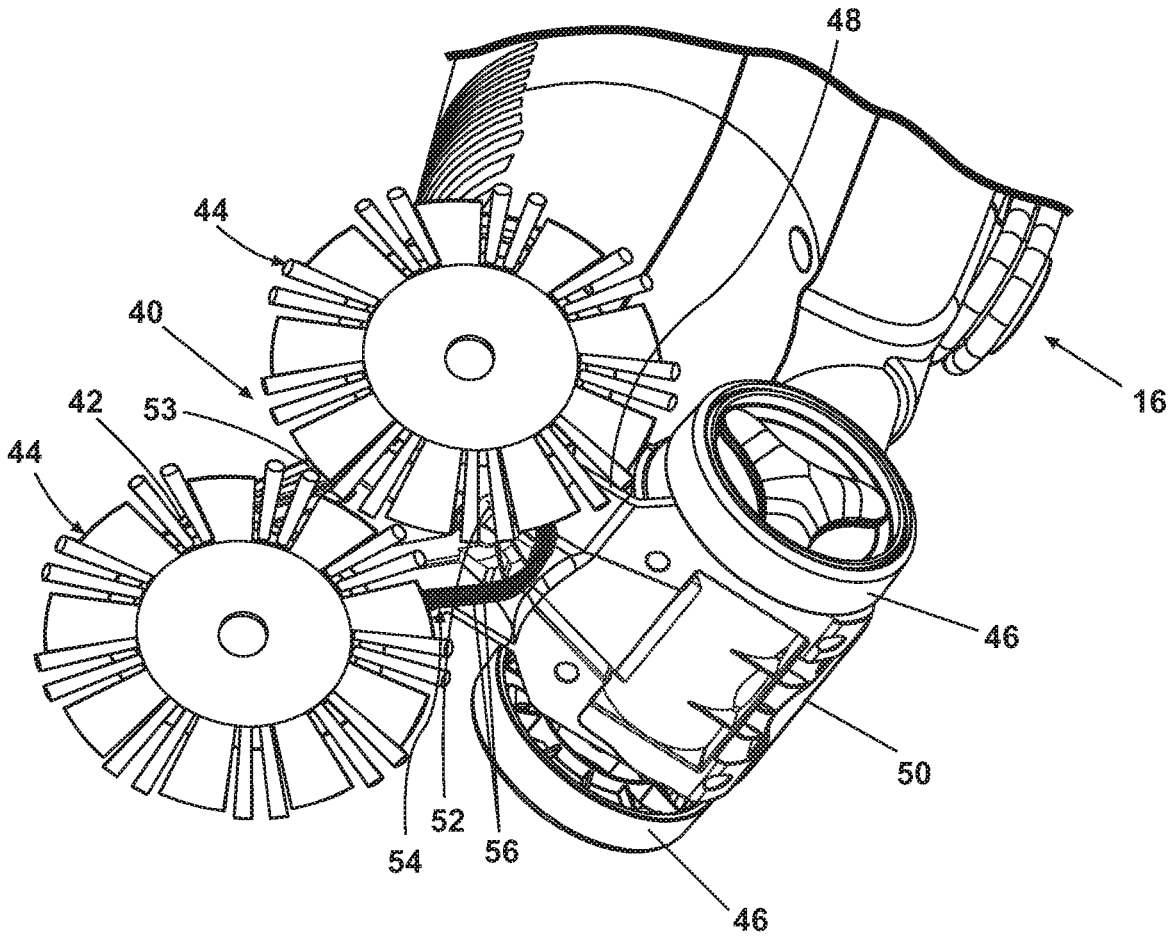
FIG. 2 is a bottom perspective view of the foot assembly including the counter-rotating agitators of the vacuum cleaner from FIG. 1.

FIG. 2 is a bottom perspective view of the foot assembly 40 of the vacuum cleaner 10 of FIG. 1, showing the two counter-rotating agitators 44 rotatably mounted to the diverging arms 53 of the agitator extension housing section 42. The suction aperture 52 is formed in the region between the two counter-rotating agitators 44 near the apex of the two diverging arms 53. Dirt that comes in contact with the counter-rotating agitators 44 is swept inwardly towards the suction aperture 52 for ingestion there through by a working airflow. The working airflow transports the dirt through the flexible conduit (not shown), through the filtration system 18, and into the dirt cup 20 on the main body 16. The filtered working airflow is exhausted to atmosphere through exhaust vents 55 in the main body 16.

A stationary strip brush 54 is disposed beneath the foot assembly 40 behind the suction aperture 52 in a generally arcuate configuration. The strip brush 54 includes at least one row of flexible bristles 56 configured act as a sweeping element to sweep and guide dirt towards the suction aperture 52 and to catch any dirt that may be swept past the suction aperture 52 by the counter-rotating agitators 44. The suction aperture 52 is located between the counter-rotating agitators 44, beneath the apex of the two diverging arms 53 and does not span the full width of the vacuum cleaner foot assembly 40. Accordingly, the working airflow velocity at the suction aperture 52 can be higher than a larger, conventional suction aperture that typically spans the entire width of a conventional vacuum cleaner foot assembly. The higher working airflow velocity can improve ingestion of dirt particles into the suction aperture 52.

Additionally, the stationary strip brush 54 directs loose dirt on the surface to be cleaned toward the suction aperture 52 so that the dirt can be ingested effectively. For example, if the vacuum cleaner 10 is pushed rapidly on a forward stroke, some of the dirt that is swept towards the suction aperture 52 by the counter-rotating agitators 44 may not be immediately ingested into the suction aperture 52. In such a case, the stationary strip brush 54 is configured to sweep any remaining dirt until the dirt can be ingested through the suction aperture 52. Additionally, the flexible bristles 56 of the stationary strip brush 54 can also bend and flick dirt particles forwardly, effectively moving the dirt closer to the suction aperture 52 so that the dirt can be ingested through the suction aperture 52. While the stationary strip brush 54 is illustrated as having a plurality of bristles 56, the stationary brush strip 54 can also be made from one or more pieces of a semi-rigid or flexible material, such as rubber, for example, for catching any dirt swept past the suction aperture 52.

Figure 3:
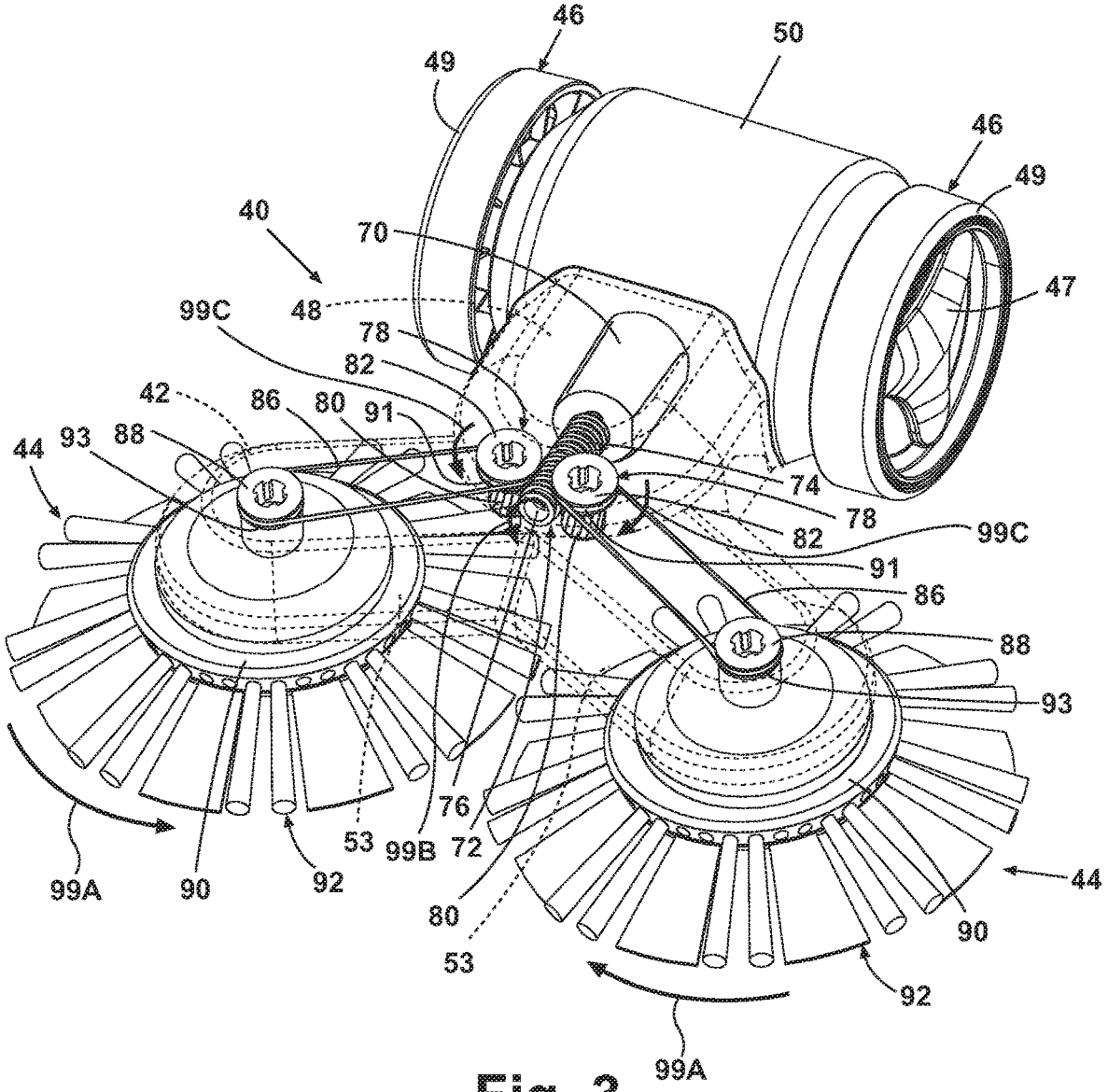
FIG. 3 is a view of the foot assembly with part of the housing made transparent to show the agitator drive mechanism of the vacuum cleaner from FIG. 1.

FIG. 3 shows a partial perspective view of the foot assembly 40 with a portion of the central housing section 48 and agitator extension housing 42 shown transparent to reveal the agitator drive system of the vacuum cleaner 10 of FIG. 1. An agitator drive motor 70 is disposed within the central housing section 48 and is adapted to drive a worm gear 72, including a worm gear shaft 76 with helical worm gear threads 74 disposed thereon. Two drive gears 78 are rotatably mounted on either side and in contact with the worm gear 72. Each gear 78 includes a shaft with vertically oriented teeth 80 and a drive gear pulley 82 fixed to the top of each gear 78. The worm gear 72 is configured to rotate the drive gears 78 as the teeth 80 of the drive gears 78 mesh with the threads 74 of the worm gear 72 in a conventional manner. Each drive gear 78 is adapted to drive a corresponding counter-rotating agitator 44 via a stretch belt 86 that extends within the respective diverging arm 53 of the agitator extension housing section 42. A stretch belt 86 operably connects the drive gear pulley 82 of the drive gear 78 with a corresponding agitator drive pulley 88 of each counter-rotating agitator 44. As each drive gear 78 rotates, the corresponding drive gear pulley 82 also rotates in the same direction and, in turn, frictionally drives each belt 86. Each belt 86, in turn, frictionally drives the corresponding agitator drive pulley 88 of each counter-rotating agitator 44. The agitator drive pulley 88 is attached to an agitator hub portion 90 that is adapted to receive a cleaning tool 92 of the counter-rotating agitator 44.

The agitator drive motor 70 can include any known type of electric motor including a conventional brushed, a brushless direct current, a universal, or an alternating current induction motor configuration, for example. In some applications, the agitator drive motor 70 can be energized when the motor/fan assembly 30 is energized. In other applications, an agitator drive power switch electrically connected within the agitator drive motor 70 power circuit can be adapted to selectively energize the agitator drive motor 70 while the vacuum cleaner 10 is operated.

The belt 86 can include an elastomeric material such as rubber, silicone, or other suitable materials commonly known in the art. The belt 86 tension can be set to allow efficient power transfer from the drive gears 78 to the counter-rotating agitators 44 without excessive slippage and wear. The perimeter of the drive gear pulley 82 and agitator drive pulley 88 can include a groove 91 and 93, respectively, therein for seating the belt 86 and preventing the belt 86 from slipping off of the pulleys 82 and 88. The grooves 91, 93 can include a roughened contact surface to increase the frictional coupling of the pulleys 82 and 88 to the belt 86, and thereby improve power transfer efficiency. Alternatively, the belt 86 can include a conventional timing belt with teeth adapted to mate with gear teeth on the perimeters of the drive gear pulley 82 and agitator drive pulley 88.

The wheels 46 are rotatably mounted to the outboard sides of the rear housing section 50 of the foot assembly 40. Each wheel 46 includes a wheel body 47 that is preferably constructed of injection molded thermoplastic and an outer tread 49 including an elastomeric material with a high coefficient of static friction to promote better grip to the surface being cleaned, such as hardwood or linoleum floor. Conventional wheels including a uniform material are also contemplated.

The agitator hub portion 90 is configured to receive the cleaning tool 92 of the counter-rotating agitator 44 and is adapted to rotate relative to the agitator extension housing section 42. The agitator hub portion 90 can be constructed from a thermoplastic material, elastomeric material, or the like. The cleaning tool 92 can be attached to the agitator hub portion 90 either permanently or removably via known retention means such as conventional hook and loop fasteners or tacky adhesive, for example. The peripheral edge of the cleaning tool 92 extends beyond the housing sections 42, 48, and 50 of the foot assembly 40, including the rear wheels 46. In this manner, the cleaning tool 92 can contact walls, baseboards, molding, and furniture legs during use. The cleaning tool 92 can include assorted materials or combinations thereof, including a plurality of flexible bristles, micro-fiber pads, disposable non-woven fibrous dusting sheets, synthetic or natural chamois pads, felt, yarn, cloth rags, or other suitable soft, deformable materials. The cleaning tool 92 is adapted to attach to the agitator hub portion 90 and to deform upon encountering obstructions while simultaneously dusting and wiping the surfaces of the obstructions. Deformation of the cleaning tool 92 is advantageous, especially for cleaning baseboards and toe kicks underneath conventional kitchen cabinets.

Figure 4:
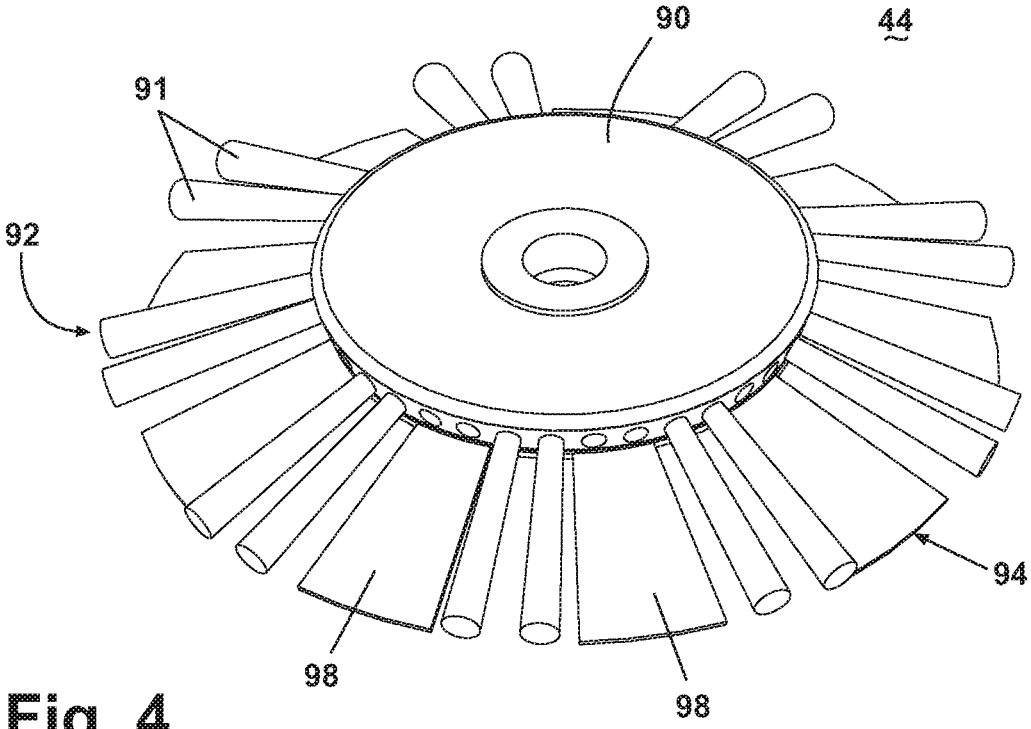
FIG. 4 is a front perspective view of a counter-rotating agitator assembly according to an aspect of the present disclosure.
Figure 5:
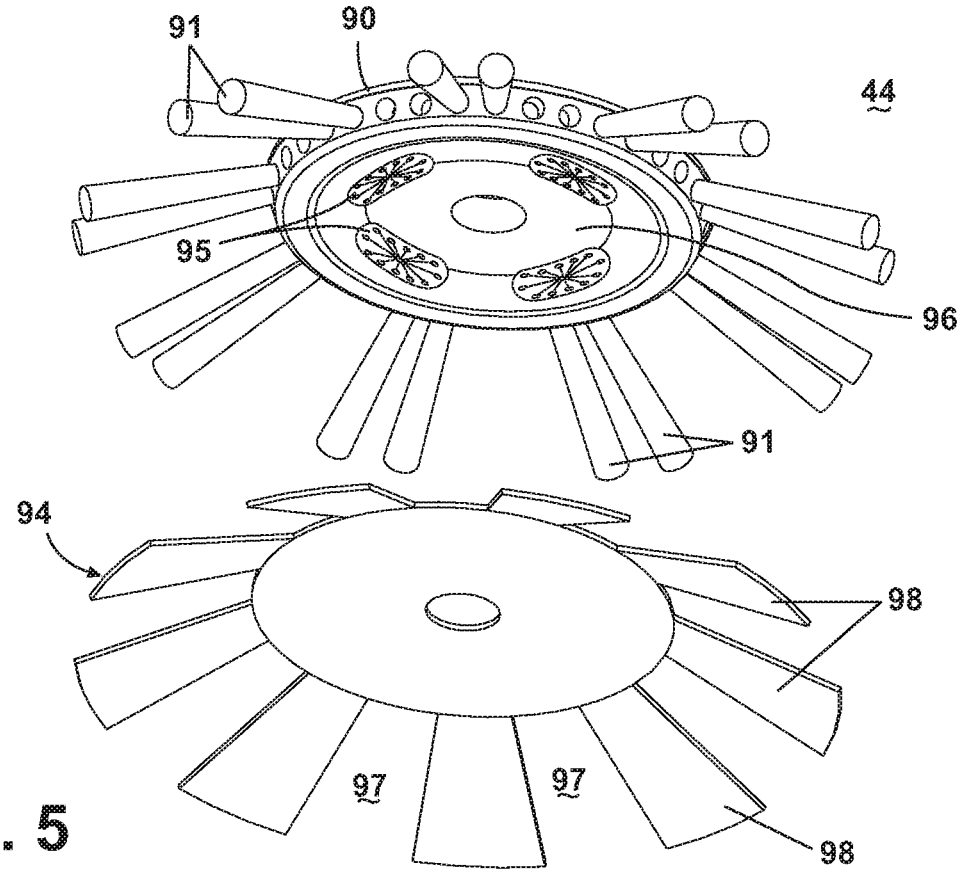
FIG. 5 is a bottom partial exploded view of a counter-rotating agitator assembly according to an aspect of the present disclosure.

Referring to FIGS. 4-5, according to one aspect of the present disclosure, the counter-rotating agitator assembly 44 includes a rigid agitator hub portion 90 with a deformable, cleaning tool 92 attached thereto. As shown in FIGS. 4-5, the cleaning tool 92 includes a combination of conventional bristle tufts 91 and a removable sheet 94 or pad. The bristle tufts 91 protrude radially from the perimeter wall of the agitator hub portion 90. The bristle tufts 91 can be secured to the agitator hub portion 90 via mechanical fasteners such as conventional staples, or by alternate attachment means commonly known in the art such as adhesive, insert molding, over molding, or the like. The bristle tufts 91 can include nylon, or natural fibers such as animal hairs. Alternatively, the bristle tufts 91 can include elastomeric materials like silicone, for example. The bristle tufts 91 can be arranged in a pattern of bristle tufts that extend radially outwardly from the agitator hub portion 90. The bristle tufts 91 can be secured to the agitator hub portion 90 at a slight downward angle relative to horizontal to enhance contact and agitation of the surface being cleaned. Ideally the bristle tufts 91 are stiff enough to dislodge dirt that is adhered to the surface being cleaned, yet flexible enough that the bristle tufts 91 will deform upon contact with furniture legs, walls, and molding without damaging such surfaces or the agitator assembly 44. Furthermore, friction between the bristle tufts 91 and the cleaning surface can generate an electrostatic charge to aid attracting and retaining dust and transporting the dust towards the suction aperture 52 through the filtration system 18 and into the dirt cup 20 of the main body 16.

The removable sheet 94 can be removably secured to a bottom wall 96 of the agitator hub portion 90 via a conventional hook and loop fastening system or via tacky adhesive. Alternatively, as shown in FIG. 5, the sheet 94 can be removably retained beneath the agitator hub portion 90 by at least one elastomeric, deformable mechanical sheet retention insert 95 mounted within the bottom wall 96 of the agitator hub portion 90. The sheet retention insert 95 can include radially extending slits in a spoke-like pattern that form deformable flaps for holding a portion of the sheet or cleaning pad 94. Examples of such retainers are disclosed in U.S. Pat. No. 3,099,855 to Nash, and U.S. Pat. No. 6,305,046 to Kingry et al., and U.S. Pat. No. 7,013,528 to Parker et al., which are incorporated herein by reference in their entirety.

The removable sheet 94 is disk-shaped and includes a plurality of uniformly spaced flexible strips 98 that extend radially from an outermost edge of the disk. Peripheral slits 97 are formed between the flexible strips 98 and are configured to receive intermittent radially spaced bristle tufts 91 therein so that the cleaning tool 92 of the counter-rotating agitator 44 includes alternating bristle tufts 91 and flexible strips 98 around the perimeter thereof (FIG. 4). The width and/or length dimensions of the peripheral slits 97 can be modified, or the slits 97 can be eliminated altogether. The removable sheet 94 can include a commercially available electrostatic dusting sheet material; however, additional materials are contemplated, including, but not limited to any one or combination of micro-fiber or ultra micro-fiber material, synthetic or natural chamois pads, felt, yarn, cloth rags, non-woven materials, or other suitable soft, deformable materials. In addition, the removable sheet 94 can be pre-moistened with water, detergent, or other liquid composition to enhance dust collection and to provide a damp mopping and/or floor treatment function.

An assortment of interchangeable cleaning tools 92 can permit a user to select various attachments for specific cleaning tasks depending on the type of dirt and/or cleaning surface. For example, a cleaning tool 92 with coarse bristles might be advantageous for removing large dirt particles, whereas an attachment with electrostatic or micro-fiber pads can be advantageous for removing smaller dirt particles and fine dust. Additionally, chamois pads and pre-moistened pads can be advantageous for damp mopping applications. Accordingly, the user can select a suitable interchangeable cleaning tool 92 that can be selectively attached to the agitator hub portion 90 depending on the specific cleaning task. The cleaning tool 92 can be removably attached to the agitator hub portion 90 by any known means including hook-and-loop fasteners, double-sided tape, tacky adhesive, or the previously mentioned elastomeric sheet retention inserts 95.

In addition, the cleaning tool 92 can be disposable or reusable. For example, a disposable cleaning tool 92 can be configured to be used one or more times by the user and then disposed of after a single use or when the user desires to replace the cleaning tool 92 with an unused cleaning tool 92. In another example, the cleaning tool 92 can be configured to be periodically removed and cleaned by the user, such as by rinsing with water or washing in a laundry washing machine or dishwasher, and then replaced back onto the agitator hub portion 90 for further use.

Referring again to FIG. 3, in operation, a user prepares the vacuum cleaner 10 for use by connecting it to a power supply and actuating the power switch 43 to energize the motor/fan assembly 30 and agitator drive motor 70. The motor/fan assembly 30 draws a working airflow through the system while the agitator drive motor 70 drives the counter-rotating agitators 44 in the direction indicated by arrows 99A via the rotating worm gear 72. Worm gear threads 74 on the worm gear shaft 76 mesh with drive gear teeth 80 of the drive gears 78 that are rotatably mounted on opposite sides of the worm gear shaft 76. Accordingly, rotation of the worm gear shaft 76 in the direction indicated by arrow 99B induces inward rotation of each drive gear 78, as indicated by the arrows 99C. The drive gear pulley 82 rotates with the drive gear 78 and induces rotation of the agitator drive pulley 88 via the frictional drive belt 86 that connects the drive gear pulley 82 to the agitator drive pulley 88. The rotating agitator drive pulley 88 is fixed to the agitator hub 90 and thus induces inward rotation of the counter-rotating agitators 44. In this manner, each counter-rotating agitator 44 is rotated in an opposite direction with respect to the other counter-rotating agitator 44. As the agitators 44 rotate, the cleaning tool 92 deforms to accommodate the contours of baseboards and furniture legs and other objects in the path of the cleaner 10. The counter-rotating agitators 44 sweep dirt inwardly towards the suction aperture 52 between the diverging arms 53, whereupon the dirt is ingested through the aperture 52 and entrained in the working airflow generated by the motor/fan assembly 30. The working airflow transports the dirt through the working airflow path until it is eventually separated by the filtration system 18 and collected in the dirt cup 20 on the main body 16 of the vacuum cleaner 10. The filtered working airflow is then exhausted to atmosphere through exhaust vents 55 in the main body 16.

Figure 6:
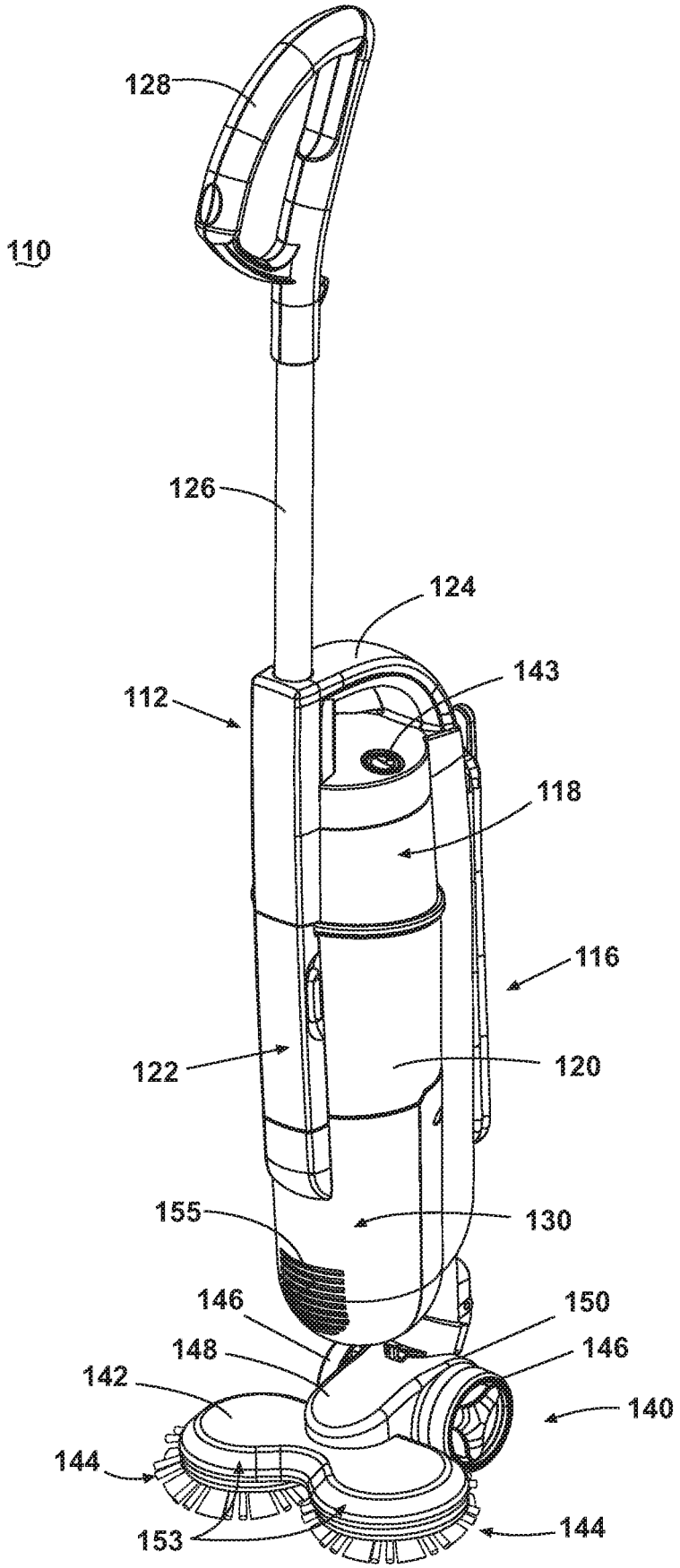
FIG. 6 is a front perspective view of a second example of a vacuum cleaner according to the present disclosure with a foot assembly including counter-rotating agitators.

FIG. 6 is a front perspective view of the second aspect of the present disclosure, where like features are indicated by the same reference numeral incremented by 100. A vacuum cleaner 110 includes an upright handle assembly 112 pivotally mounted to a foot assembly 140 including counter-rotating agitators 144. As in the previous example, the upright handle assembly 112 includes a main body 116 that houses a motor/fan assembly 130 for generating a working airflow, a filtration system 118 for separating dirt from an airflow and a removable dirt cup 120 for receiving and collecting the separated dirt from the filtration system 118. The dirt cup 120 has a latch mechanism 122 for selectively latching the dirt cup 120 to the main body 116. The main body 116 further includes a handle 126 with a second hand grip 128 at one end for maneuvering the vacuum cleaner 110 over a surface to be cleaned.

The foot assembly 140 includes a rear housing section 150 configured to rotatably mount rear wheels 146 on either side thereof. The main body 116 is pivotally mounted to the rear housing section 150 via a swivel joint (not shown). A flexible conduit (not shown) within the rear housing section 150 fluidly connects the working airflow path in the foot assembly 140 to the working airflow path in the main body 116. The foot assembly 140 further includes a central housing section 148 positioned forwardly of the rear housing section 150. As will be discussed in reference to FIG. 8, the central housing section 148 encloses an agitator drive system that is operably connected to the counter-rotating agitators 144. An agitator housing section 142 is attached to the central housing section 148 and is adapted to rotatably receive the two counter-rotating agitators 144 within a pair of generally dome-shaped enclosures. The agitator housing section 142 is configured so that at least a portion of the counter-rotating agitators 144 extend beyond the perimeter of the agitator housing section 142.

The motor/fan assembly 130 enclosed within the main body 116 is configured to generate a working airflow and is fluidly connected to the filtration system 118 that is adapted to separate dirt from the dirt laden airflow. The motor/fan assembly 130 can be located in either of the foot assembly 140 as well as the upright handle assembly 112 without departing from the scope of this disclosure. Additionally, the motor/fan assembly can be located either downstream or upstream from the filtration system 118.

Figure 7:
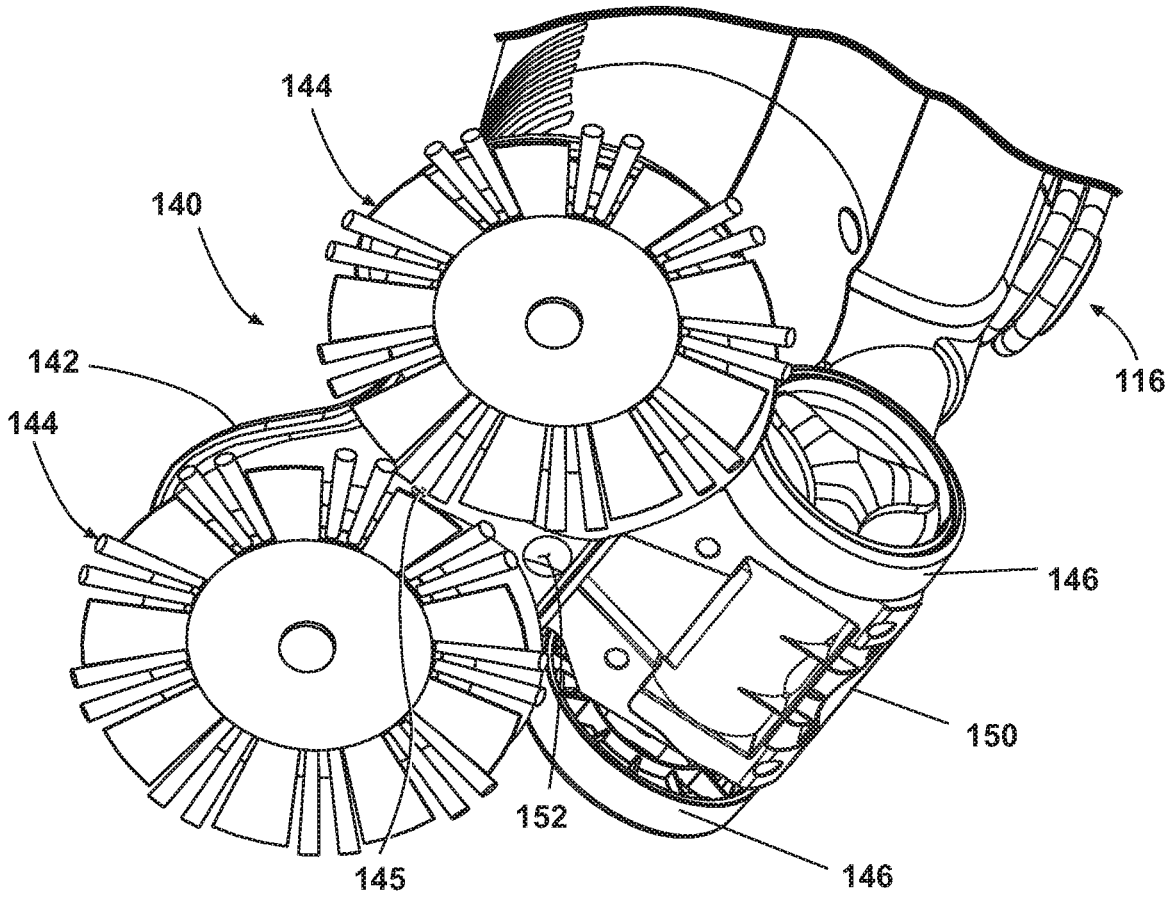
FIG. 7 is a bottom perspective view of the foot assembly including the counter-rotating agitators of the vacuum cleaner from FIG. 6.

FIG. 7 is a bottom perspective view of the foot assembly 140 of the vacuum cleaner 110 of FIG. 6, showing the two counter-rotating agitators 144 rotatably attached to the agitator housing section 142. The counter-rotating agitators 144 can be sized so the outer diameters of the counter-rotating agitators 144 engage along an agitator contact area 145 formed near a centrally located vertical plane that divides the right and left hand portions of the foot assembly 140. A suction aperture 152 is located rearwardly of the agitator contact area 145. The counter-rotating agitators 144 are adapted to sweep dirt towards the suction aperture 152 whereupon the dirt can be ingested through the suction aperture 152 and entrained within the working airflow, which transports the dirt through the working airflow path where it is eventually separated by the filtration system 118 and collected in the dirt cup 120 on the main body 116 of the vacuum cleaner 110. The filtered working airflow is exhausted to atmosphere through exhaust vents 155 in the main body 116.

Figure 8:
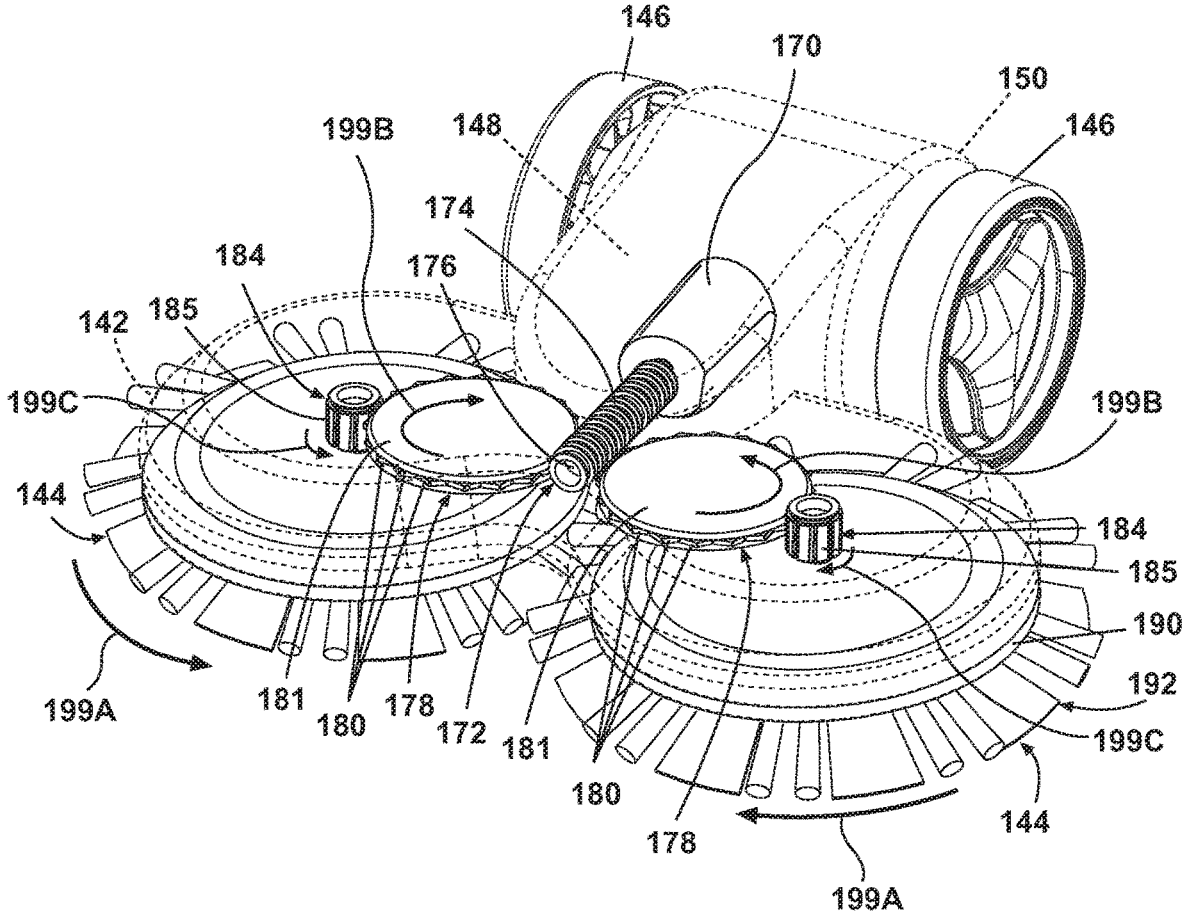
FIG. 8 is a view of the foot assembly with part of the housing made transparent to show the agitator rotation mechanism of the vacuum cleaner from FIG. 6.

Referring to FIG. 8, the foot assembly 140 includes the rear housing section 150, central housing section 148, and agitator housing section 142 further including the agitator drive system of the vacuum cleaner 110 of FIG. 6. A drive motor 170 mounted within the central housing section 148 is configured to rotate a worm gear 172, including a worm gear shaft 176 having helical worm gear threads 174 disposed around the outer surface thereof. Two drive gears 178, are rotatably mounted on either side of and in contact with the worm gear 172. Each drive gear 178 includes a shaft 181 with teeth 180 disposed around the perimeter. The helical threads 174 of the worm gear 172 are configured to mesh with the teeth 180 of the drive gears 178 in a conventional manner so that rotation of the worm gear 172 simultaneously rotates the drive gears 178. The drive gears 178, in turn, are mechanically engaged with the counter-rotating agitators 144 via agitator gears 184 attached to an upper surface of each counter-rotating agitator assembly. Each agitator gear 184 can include a conventional spur gear having teeth 185 adapted to mesh with the teeth 180 of the drive gear 178.

The outer boundary of foot assembly 140 can be more compact than foot assembly 40 because the two counter-rotating agitators 144 are rotatably mounted adjacent to each other within an agitator housing section 142 having a pair of arms 153 that are obtuse relative to each other and not the V-shaped diverging arms 53 of the agitator extension housing 42 shown in FIGS. 1-3. Furthermore, the counter-rotating agitators 144 are positioned to engage along an agitator contact area 145 during operation, which further reduces the foot print size. The amount of overlap in the contact area 145 between the agitators 144 can be determined experimentally or empirically and can vary depending on the type of cleaning tool 192 used with the agitator 144.

The operation of the second aspect of the present disclosure is substantially similar to the operation of the previous example except for the drive train and agitator housing configuration. A user prepares the vacuum cleaner 110 for use by connecting it to a power supply and actuating the power switch 143. The motor/fan assembly 130 draws a working airflow through the system while the agitator drive motor 170 drives the counter-rotating agitators 144 in the direction indicated by arrows 199A via the rotating worm gear 172. Worm gear threads 174 on the shaft 176 mesh with drive gear teeth 180 on the drive gears 178 that are rotatably mounted on opposite sides of the worm gear shaft 176. The drive gears 178 engage agitator gears 184 that are fixed to the agitator hub portion 190. As the worm gear 172 rotates, each drive gear 178 rotates outwardly, as indicated by arrows 199B, and rotate the agitator gears 184 inwardly, as indicated by arrows 199C, thus inducing inward rotation of the counter-rotating agitators 144 to sweep dirt inwardly towards the suction aperture 152 within the agitator housing section 142. The dirt is ingested through the aperture 152 and entrained in the working airflow generated by the motor/fan assembly 130. The working airflow transports the dirt through the working airflow path, is separated by the filtration system 118, and is collected in the dirt cup 120 on the main body 116 of the vacuum cleaner 110. The filtered working airflow is exhausted to atmosphere through exhaust vents 155 in the main body 116.

Figure 9:
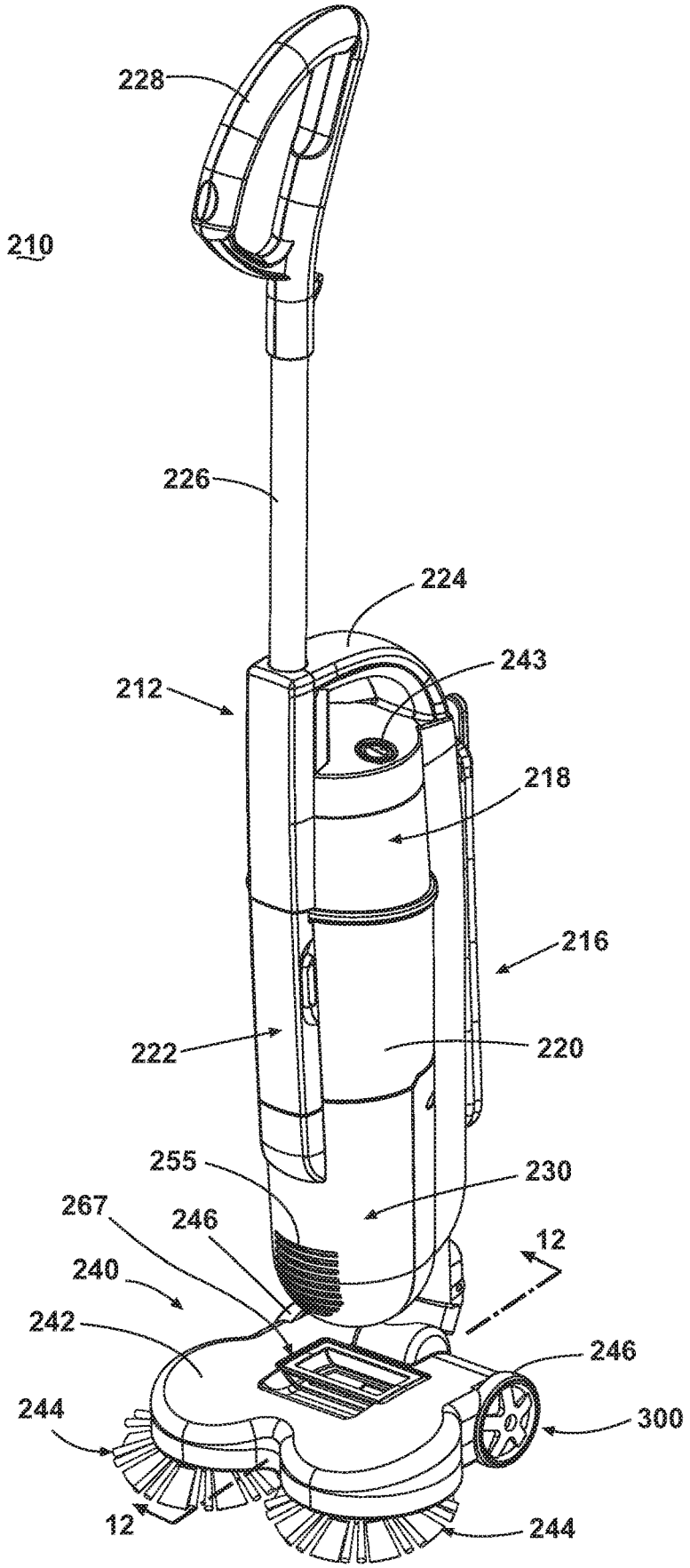
FIG. 9 is a front perspective view of a vacuum cleaner with a second example of a foot assembly including counter-rotating agitators.

FIG. 9 is a front perspective view of a vacuum cleaner 210 according to a third aspect of the present disclosure where like features are indicated by the same reference numeral incremented by 200. The vacuum cleaner 210 includes an upright handle assembly 212 pivotally mounted to the foot assembly 240 including counter-rotating agitators 244. However, the counter-rotating agitators 244 are mechanically coupled to rear wheel assemblies 306 so that manual propulsion of the vacuum cleaner 210 rotates the rear wheel assemblies 306 and thereby rotates the agitators 244 as will be described hereinafter.

The upright handle assembly 212 includes a main body 216 that houses a motor/fan assembly 230 that generates a working airflow and is in fluid communication with an upstream filtration system 218 and working airflow path. The motor/fan assembly 230 mounted within a lower portion of the main body 216 and can be selectively energized via a conventional power switch 243 also mounted in the main body 216. The filtration system 218 is configured to separate dirt from a dirt-laden airflow and a removable dirt cup 220 is adapted to receive and collect the separated dirt from the filtration system 218. The dirt cup 220 has a latch mechanism 222 for selectively latching the dirt cup 220 to the main body 216. The main body 216 further includes an upright handle 226 with a second hand grip 228 at one end for maneuvering the vacuum cleaner 210 over a surface to be cleaned. It will be understood by one skilled in the art that the motor/fan assembly 230 can be located in the foot assembly 240 or the upright handle assembly 212 and can further be positioned either upstream or downstream from the filtration system 218 without departing from the scope of this disclosure.

Referring to FIGS. 9-12, the foot assembly 240 includes an upper housing 242, intermediate housing 264, and a bottom housing 300, which, when secured together via mechanical fasteners form cavities there between for receiving and mounting various components. A plurality of bosses 302 extend upwardly from the bottom housing 300 and are configured to mate with intermediate bosses 304 that protrude from a bottom wall of the intermediate housing 264, which, in turn, mate with corresponding mounting features on the upper housing 242 (not shown), thus permitting the housings 242, 264 and 300 to be secured together with conventional fasteners such as screws, for example.

Rear wheel assemblies 306 are rotatably mounted at the sides of the foot assembly 240. Each rear wheel assembly 306 includes a wheel axle 308 with a wheel pulley 310 disposed thereon and further including a rear wheel 246 mounted at the distal end of the wheel axle 308. The wheel pulley 310 and rear wheel 246 can be fixed to the wheel axle 308 by keying the respective components, or via ultra-sonic welding, adhesive, or other commonly known manufacturing techniques. Aligned notches 312 formed in mounting ribs 314 and sidewalls of the intermediate housing 264 and sidewalls of the upper housing 242 form axle bearings that are configured to rotatably receive the wheel axles 308 therein. The entire rear wheel assembly 306 is configured to rotate with respect to the axle bearings 312 such that rotation of the rear wheel assemblies 306 induces rotation of the wheel pulleys 310. The front of the foot assembly 240 is supported by rollers 316 that are rotatably mounted beneath the front corners of the bottom housing 300. Drive belts 286 wrap around one wheel pulley 310 and a corresponding agitator pulley 288 at both sides of the foot assembly 240. Each drive belt 286 is slidably supported by a rotating direction changing spindle 260. Each spindle 260 is transversely and rotatably mounted within a spindle holder 318 that protrudes upwardly from the bottom wall of the intermediate housing 264. The direction changing spindle 260 twists the belt 286 from a substantially vertical orientation at the wheel pulley 310 to a substantially horizontal orientation at the agitator pulley 288.

A dirt cup aperture 261 formed in the top wall of the upper housing 242 is aligned with a corresponding pocket 263 in the intermediate housing 264 and dirt cup support wall 265 in the bottom housing 300 to form a mounting recess for an intermediate dirt cup 267 therein.

The intermediate dirt cup 267 includes an elongate L-shaped structure with a hand grip 269 formed along an upper portion and a dirt collection chamber 271 formed in a lower portion thereof. The intermediate dirt cup 267 further includes inlet 273 formed along the lower front face and an exhaust aperture 275 along the top rear wall that fluidly connect the intermediate dirt cup 267 to the working airflow path as will be described hereinafter.

Figure 10:
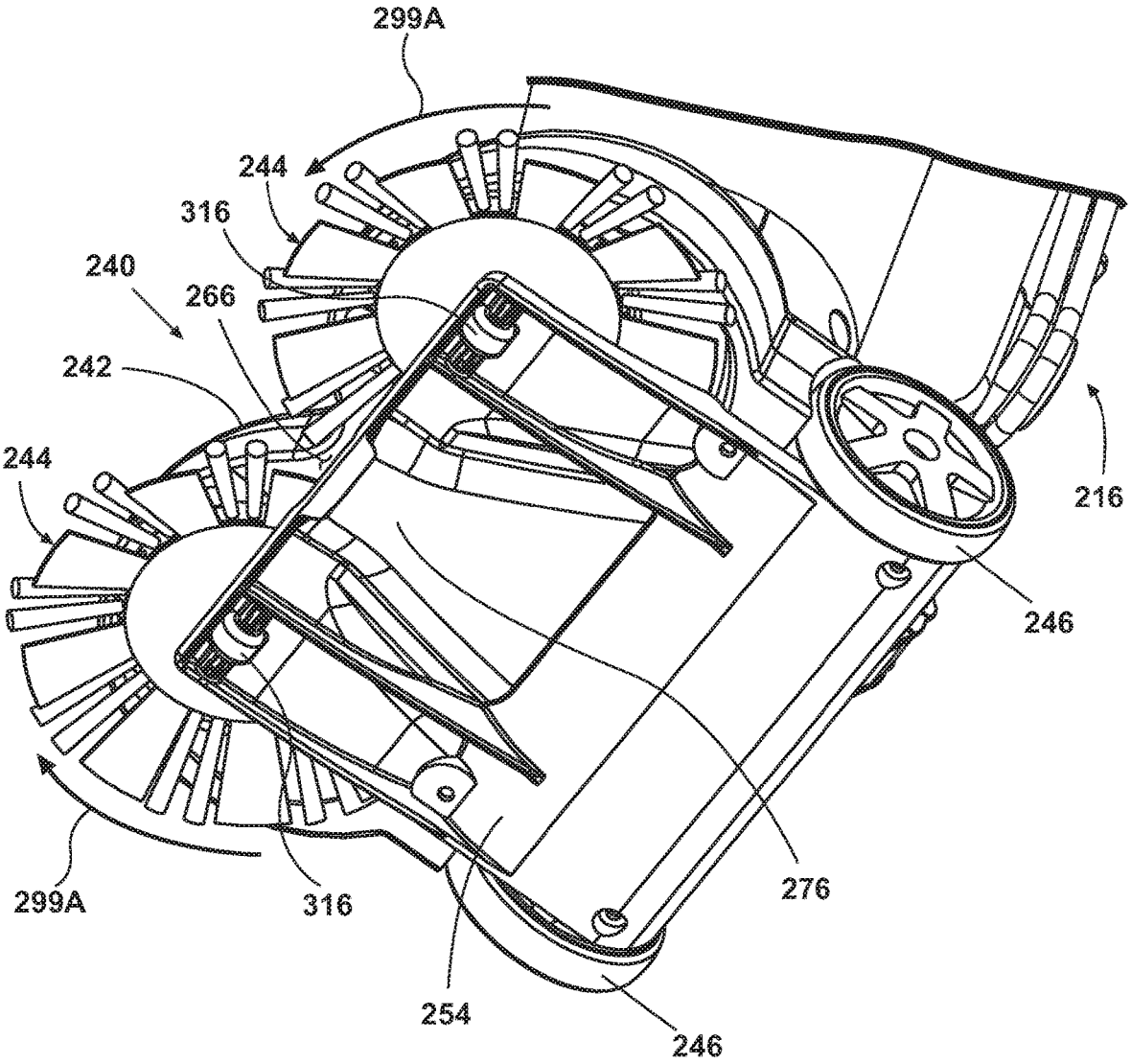
FIG. 10 is a bottom perspective view of the foot assembly including the counter-rotating agitators of the vacuum cleaner from FIG. 9.
Figure 11:
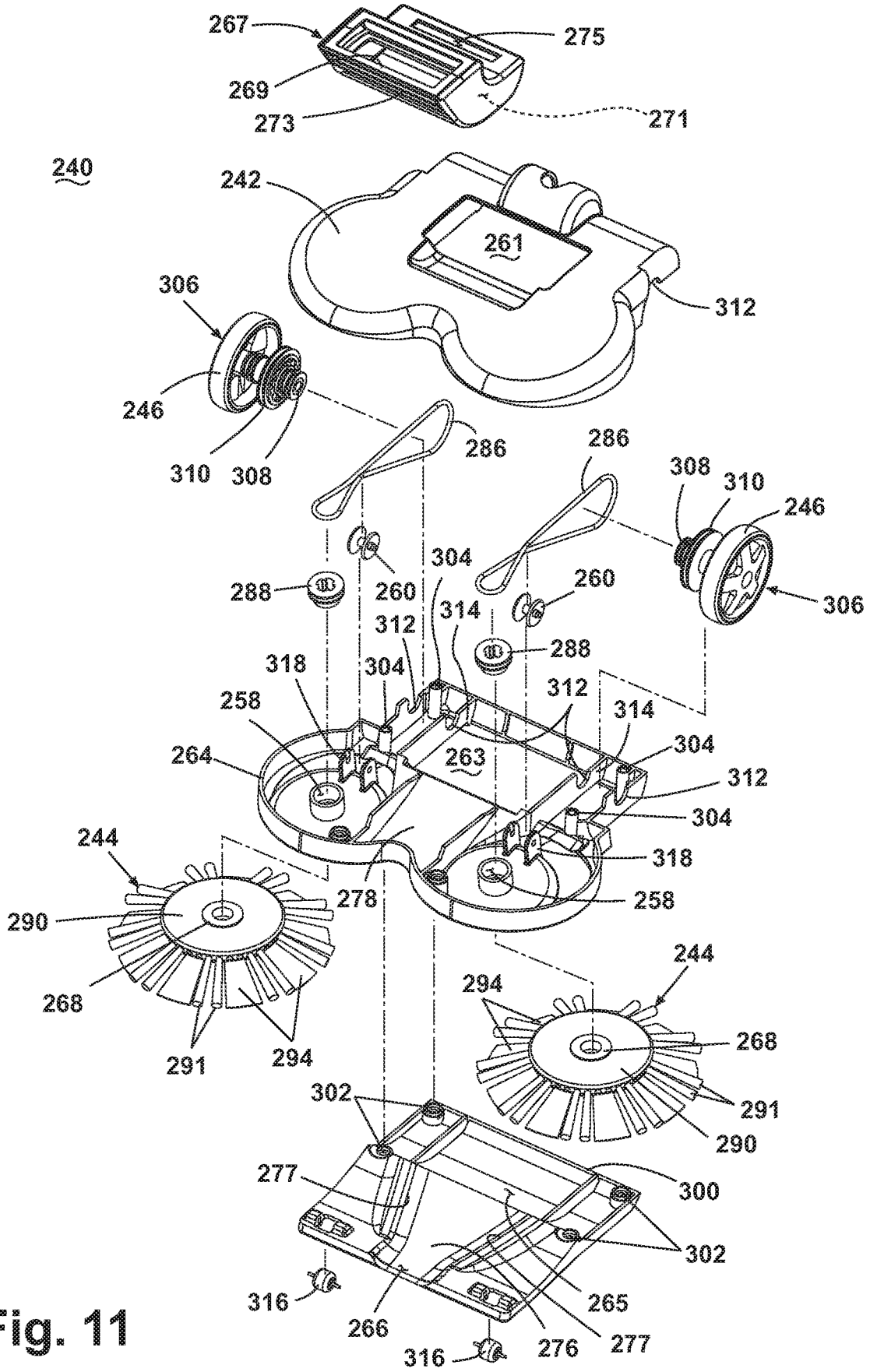
FIG. 11 is an exploded view of the foot assembly according to a third example of the present disclosure as shown in FIG. 9.

FIG. 10 is a bottom perspective view of the foot assembly 240 of the cleaner shown in FIG. 9. A suction aperture 266 is formed between a leading edge of the bottom housing 300 and the intermediate housing 264. Referring to FIGS. 10-12, an inclined dirt inlet ramp 276 forms the bottom wall of a dirt path that is further defined by dirt ramp sidewalls 277 in the bottom housing 300 and a dirt ramp top 278 formed at a forward portion of the intermediate housing 264. A dirt ramp outlet 279 is in fluid communication with the intermediate dirt cup inlet 273 and the dirt collection chamber 271 formed at a lower portion of the intermediate dirt cup 267. The intermediate dirt cup exhaust aperture 275 is formed in a top wall of the dirt collection chamber 271 and is adapted for selective fluid connection to a flexible conduit 320 (shown in schematic form in FIG. 12) within the rear portion of the foot assembly 240 that, in turn, fluidly connects the working airflow path in the foot assembly 240 to the working airflow path in the main body 216. The intermediate dirt cup 267 is adapted to be selectively installed and removed within the mounting recess formed by the aperture 261 in the upper housing 242, the adjacent pocket 263 in the intermediate housing 264 and the corresponding dirt cup support wall 265 in the bottom housing 300. Dirt and debris collected within the collection chamber 271 can be emptied either by removing the intermediate dirt cup 267 and tipping it forward to induce debris to fall out of the inlet aperture 273, or by applying suction to the exhaust aperture 275 when the intermediate dirt cup 267 is installed in its mounting recess within the foot assembly 240. When suction is applied to the exhaust aperture 275, the collected dirt and debris is evacuated from the elongate dirt collection chamber 271 through the exhaust aperture 275 and becomes entrained into the working airflow for separation in the downstream filtration system 218 and collection in the downstream dirt cup 220 that is selectively mounted to the main body 216.

Counter-rotating agitators 244 are rotatably mounted beneath the front of the intermediate housing 264 within an agitator cavity formed between the bottom housing 300 and the intermediate housing 264. The two counter-rotating agitators 244 are mounted in a manner such that at least a portion of the counter-rotating agitators 244 extend beyond the perimeters of the upper housing 242, intermediate housing 264, and bottom housing 300. Preferably, the counter-rotating agitators 244 can be canted forwardly so that the forward most portion of the agitators 244 is in register with the surface to be cleaned whereas the rearward most portion of the agitator is not in register with the surface to be cleaned (FIG. 12). Cylindrical agitator bearings 258 protrude upwardly near the front corners of the intermediate housing 264 in front of the spindle holders 318. An agitator pulley 288 and a mounting ring 268 at the center of the agitator hub portion 290 are engaged from opposite ends of the agitator bearing 258. The pulley 274 and mounting ring 268 and are adapted to snap-fit around the agitator bearing 258 so the entire agitator 244 can rotate freely relative to the agitator bearing 258. Alternatively, the agitator pulley 288 and mounting ring 268 can be joined by a welding process, adhesive, or separate mechanical fasteners.

The agitator pulleys 288 are coupled to wheel pulleys 310 via drive belts 286. The wheel pulleys 310 are mechanically coupled to the wheels 246 and rotate with the wheel assemblies 306 rotate as previously described. Alternatively, the wheel pulley 310 or the agitator pulley 288 can include a conventional one-way clutch mechanism that limits rotation of the counter-rotating agitators 244 in a single rotational direction indicated by the arrows shown on FIG. 10. Examples of such a clutch mechanism are disclosed in U.S. Pat. No. 1,421,957 to Kirby, and U.S. Pat. No. 1,972,870 to Christesen, and U.S. Pat. No. 642,172 to Swietzer et al., which are incorporated herein by reference in their entirety. A portion of the belt 286 is slidably supported by the direction changing spindle 260, which in turn sits on the spindle holder 318 protruding from the intermediate housing element 264. As in the previous examples, a cleaning tool 292 is attached to the agitator hub portion 290 that includes a combination of conventional bristle tufts 291 and a removable sheet 294 or pad affixed thereto.

In operation, the vacuum cleaner 210 can be operated either with or without energizing the motor/fan assembly 230 via the power switch 243. When the cleaner 210 is plugged into a line power source and the power switch 243 is actuated, the motor/fan assembly 230 becomes energized and generates a working airflow through the working airflow path. A user maneuvers the cleaner 210 across the surface to be cleaned by pushing and pulling the second hand grip 228 forwards and backwards in a reciprocal motion. As a user pushes the cleaner on a forward stroke, the foot 240 moves forward, the rear wheels 246 rotate forwardly and, in turn, rotate the wheel axles 308 and wheel pulleys 310 disposed thereon, thus moving the belts 286, which induce rotation of the counter-rotating agitators 244 via the agitator pulleys 288. Accordingly, the counter-rotating agitators 244 rotate only when the wheels 246 rotate. The forward most portion of the counter-rotating agitators 244 sweep inwardly, as indicated by arrows 299A in FIG. 10, and direct dirt towards the centrally located suction aperture 266 at the base of the dirt inlet ramp 276. As the counter-rotating agitators 244 sweep dirt towards the suction aperture 266, the high velocity working airflow entrains the dirt and transports it through the working airflow path, up the dirt inlet ramp 276, through the dirt ramp outlet 279 and through the intermediate dirt cup inlet 273. The dirt remains entrained in the working airflow as it passes through the collection chamber 271 and passes through the exhaust aperture 275 in the top of the intermediate dirt cup wall. The dirty working airflow continues to flow through the flexible conduit 320 and the downstream filtration system 218, whereupon the dirt is separated and collected in the dirt cup 220 on the main body 216 of the vacuum cleaner 210 and the filtered working airflow exits through exhaust vents 255 adjacent to the motor/fan assembly 230. The dirt cup 220 can be selectively removed from the main body 216 for emptying by depressing the latch mechanism 222 to release the dirt cup 220 from the main body 216.

When the cleaner 210 is used without energizing the motor/fan assembly 230, the cleaner functions as a manual sweeper and does not generate a working airflow though the working airflow path. Instead, as a user pushes the cleaner on a forward stroke, the foot 240 moves forward, rotating the rear wheel assemblies 306 forwardly, which moves the belts 286 and induces rotation of the counter-rotating agitators 244. The counter-rotating agitators 244 sweep inwardly and direct dirt through the suction aperture 266 at the base of the dirt inlet ramp 276. The momentum of the dirt carries it up the dirt inlet ramp 276, through the intermediate dirt cup inlet 273, where it is collected in the collection chamber 271 of the intermediate dirt cup. When the intermediate dirt cup 267 becomes full, a user can grasp the hand grip 269 on the top portion to lift the intermediate dirt cup 267 from the mounting recess in the foot assembly 240. A user can then tip the intermediate dirt cup 267 forwardly to empty the dirt through the inlet aperture 273 and into a suitable container. Alternatively, a user can empty the intermediate dirt cup 267 by selectively energizing the motor/fan assembly 230 by connecting the unit to a line power source and depressing the power switch 243 while the intermediate dirt cup 267 is mounted within the mounting recess. The debris collected in the collection chamber 271 thus becomes entrained in the working airflow and is transported to the dirt cup 220 mounted to the main body 216.

Figure 13:
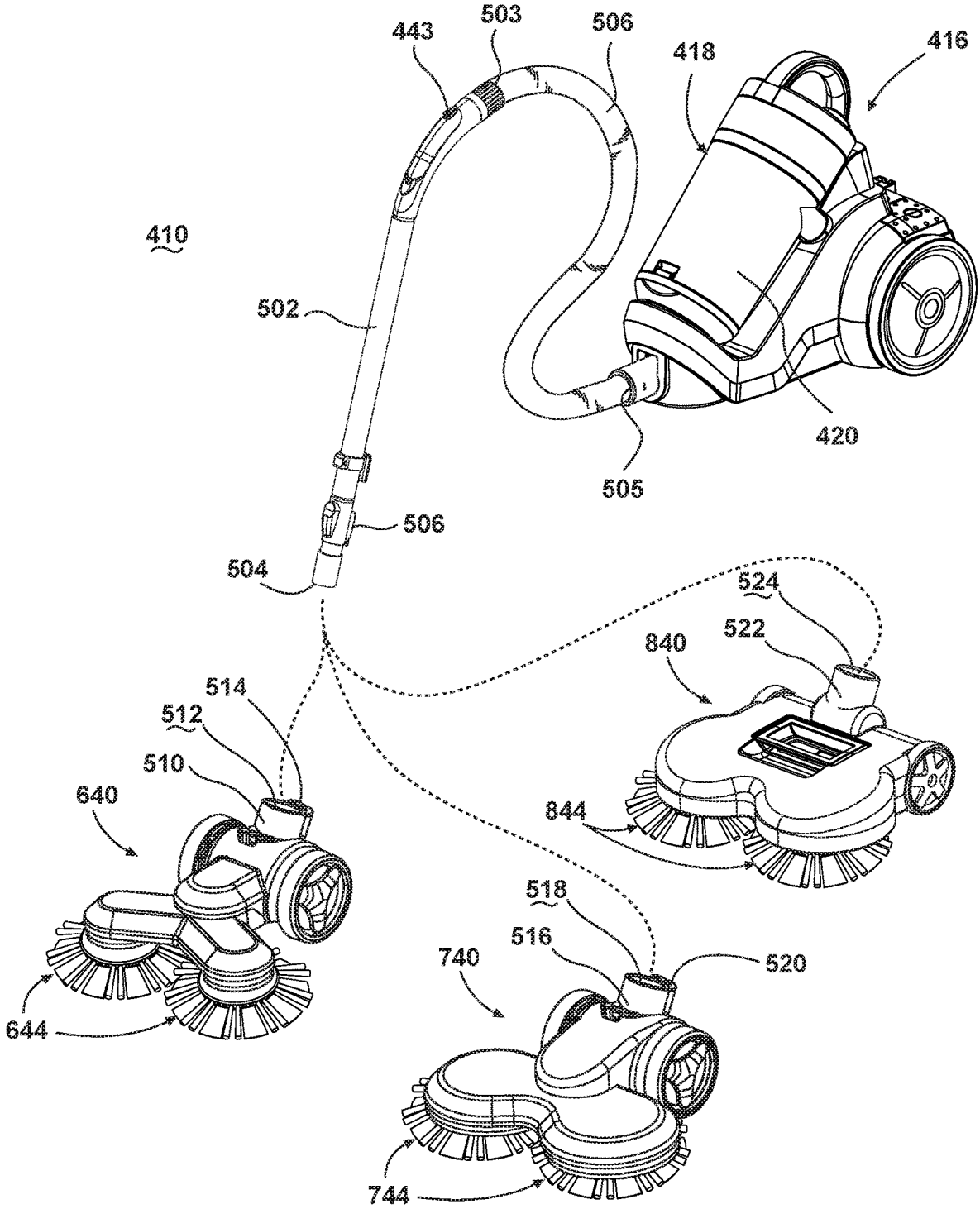
FIG. 13 is a front perspective of a vacuum cleaner in the form of a canister type vacuum cleaner for use with a foot assembly according to another aspect of the present disclosure.

FIG. 13 illustrates an example of how each of the foot assemblies 40, 140, and 240 can be used with a canister type vacuum cleaner 410. Each foot assembly 640, 740 and 840 is similar to the previously described foot assemblies 40, 140 and 240, respectively, except for the manner in which the foot assemblies 640, 740 and 840 are coupled with the canister vacuum cleaner 410. Therefore, elements in the foot assemblies 640, 740 and 840 similar to those of the foot assemblies 40, 140 and 240, respectively, will be numbered with the prefix 600, 700 and 800, respectively.

The canister vacuum cleaner 410 includes a suction wand handle assembly 502 which is coupled at a first end 503 with a hose 506, which is, in turn, fluidly connected with the canister body 416 via a hose fitting 505. The suction wand handle assembly 502 can be selectively coupled at a second, opposite end 504 with one of the foot assemblies 640, 740 and 840. The second end 504 of the suction wand handle assembly 502 can be received in a swivel conduit 510, 516 or 522 of any of the foot assemblies 640, 740 and 840, and secured therein using a detent mechanism (not shown) or any other mechanism known in the art. The swivel conduit 510, 516, 522 of each foot assembly 640, 740 and 840 includes an outlet 512, 518 and 524, respectively, for the working airflow and entrained debris to flow through to the filtration system 418 and dirt cup 420 during operation, in a manner similar to that described above for the cleaner 10. Foot assemblies 640 and 740 also include a power socket 514 and 520, respectively, for connecting with a power connector 506 adjacent the second end 504 of the hose 502, as is known in the art. In this manner, when the canister vacuum cleaner 410 is connected with the foot assemblies 640 and 740, power can be transmitted from the canister vacuum cleaner 410 to the foot assemblies 640 and 740 for rotating the counter-rotating agitators 644 and 744, for example. Although foot assembly 840 has been disclosed as including a manual, friction drive agitator drive system, it too can optionally be adapted with an electric agitator drive mechanism and can be fitted with a power socket for furnishing power from the power connector 506 to the electric drive mechanism in a manner similar to foot assemblies 640 and 740.

Typical vacuum cleaners have a suction inlet located generally adjacent the front of the foot assembly that spans at least the majority of the width of the cleaning path defined by the foot assembly. The cleaners described herein utilize a reduced diameter suction inlet positioned rearwardly of counter-rotating agitators. The reduced diameter suction inlet provides for a more efficient use of suction power compared to a suction inlet that spans the entire cleaning path. The more efficient use of suction power allows for the use of a smaller vacuum motor, thus consuming less power and saving money, while not negatively impacting the overall cleaning performance of the cleaner. The use of counter-rotating agitators mounted along a vertical axis, rather than a traditional, horizontally-mounted brush roll, provides the ability to design a foot assembly with a lower profile, thus improving accessibility under cabinet toe-kicks and furniture, for example.

In addition, the use of an intermediate dirt cup and counter-rotating agitators that are coupled with the cleaner wheels for concomitant rotation as the cleaner is moved over the surface to be cleaned, provides for a multi-functional cleaner that can be used with or without electrical power, which can increase functionality and user satisfaction with the cleaner. For example, for small or quick clean-ups, the user can simply move the cleaner over the surface to be cleaned, sweeping dirt and debris on the surface into the intermediate dirt cup through the rotation of the counter-rotating agitators without the use of suction. This saves the user the time and hassle of unwinding and plugging in the power cord, and is also quieter than a cleaning process which uses a motor to generate suction. For larger or harder to clean tasks, the user can plug in the cleaner and actuate the suction motor to take advantage of the cleaning power of suction in combination with the counter-rotating agitators.

The intermediate dirt cup is configured for easy removal, emptying and re-insertion after use. This allows the user to use the cleaner multiple times without powering on the cleaner. The intermediate dirt cup is also configured to be emptied simply by actuating the suction motor, thus drawing the dirt collected within the intermediate dirt cup into the main dirt cup. The main dirt cup can then be removed and emptied as described above. In this manner, in one step, the user can empty both dirt collection chambers.

In the foregoing discussion, dirt is any material that is removed from the surface to be cleaned. Dirt can include, but is not limited to, dust, debris, organic or inorganic particles, including human and animal based debris such as dead skin cells and hair. The surface to be cleaned can include any surface including floors, carpets, upholstery, drapery and rugs. However, the vacuum cleaner described is particularly suited for cleaning floors, including wood, hardwood, linoleum, laminate, plastic, ceramic, concrete, tile, textured concrete, stone, or metal floors.

While the disclosure has been specifically described in connection with certain specific embodiments thereof, it is to be understood that this is by way of illustration and not of limitation. Reasonable variation and modification are possible within the scope of the foregoing disclosure and drawings without departing from the spirit of the invention which is defined in the appended claims. Although various examples of corded cleaning devices have been shown herein, it will also be understood that alternative power sources, such as rechargeable batteries, can also be used without departing from the scope of this invention to make household cleaning more convenient by not having to unstow, plug in and again stow a power cord. U.S. Pat. Nos. 6,968,593, 6,125,498 and 7,013,528 show various examples of alternative power sources and are incorporated herein in their entirety. Furthermore, the illustrated vacuum cleaner is but one example of the variety of vacuum cleaners with which this invention or some slight variant can be used.

While shown and described for use with an upright or "stick"-type vacuum cleaner, the invention described herein can be used with any type of vacuum cleaner, such as canister vacuum cleaners, robotic vacuum cleaners, hand-held vacuum cleaners, or built-in central vacuum cleaning systems. The invention can also be used with vacuum cleaners adapted to take up fluids, such as extractors and steam cleaners.

To the extent not already described, the features and structures of the various embodiments may be used in combination with each other as desired. That one feature may not be illustrated in all of the embodiments is not meant to be construed that it cannot be, but is done for brevity of descriptions. Thus, the various features of the different embodiments may be mixed and matched as desired to form new embodiments, whether or not the new embodiments are expressly described.

What is claimed is:

1. A surface cleaning apparatus, comprising:
- a housing;
- at least one rotatable agitator located on the housing in juxtaposition with a surface to be cleaned, the at least one rotatable agitator adapted to be dampened;
- a suction inlet;
- a suction source to produce a working airflow;
- a dirt cup in fluid communication with the suction inlet; and
- a dirt inlet ramp forms a bottom wall of a dirt path from the suction inlet to a dirt ramp outlet and the dirt ramp outlet is fluidly coupled with the dirt cup; and
- wherein the surface cleaning apparatus is configured to provide a manual damp mopping by manipulating the surface cleaning apparatus over the surface being cleaned without activating the suction source.

2. The surface cleaning apparatus of claim 1 wherein the manual damp mopping includes applying a floor treatment.

3. The surface cleaning apparatus of claim 1 wherein the at least one rotatable agitator can be dampened with at least one of water, detergent, or a liquid composition.

4. The surface cleaning apparatus of claim 1 wherein the at least one rotatable agitator is a removable sheet or a removable pad.

5. The surface cleaning apparatus of claim 4 wherein the removable sheet or the removable pad is pre-moistened with at least one of water, detergent, or other liquid composition.

6. The surface cleaning apparatus of claim 4 wherein the housing includes a foot assembly adapted to be moved across a surface to be cleaned and having the suction inlet and an upright handle assembly pivotally mounted to the foot assembly.

7. The surface cleaning apparatus of claim 6, further comprising a stationary strip brush disposed on the foot assembly behind the suction inlet.

8. The surface cleaning apparatus of claim 7 wherein the stationary strip brush comprises at least one row of bristles.

9. The surface cleaning apparatus of claim 1 wherein the at least one rotatable agitator comprises a hub comprising at least one retainer that is adapted to receive at least one cleaning element, the at least one cleaning element comprising a flexible pad, brushes, bristles, a micro-fiber pad, a disposable non-woven fibrous dusting sheets, a synthetic chamois pad, a natural chamois pad, felt, yarn, cloth rags or any combination thereof.

10. The surface cleaning apparatus of claim 9 wherein the hub comprises resilient bristle tufts disposed at intervals around a perimeter of the hub and extending substantially radially outwardly therefrom and the at least one cleaning element comprises radial strips separated by radial slits, the radial strips being configured to intermingle in spaces formed between the resilient bristle tufts on the hub when the cleaning element is mounted to the hub.

11. The surface cleaning apparatus of claim 9 wherein the at least one cleaning element is a damp cleaning element.

12. A surface cleaning apparatus, comprising:
- a housing mounted to a handle or wand assembly;
- a suction source to produce a working airflow;
- a filtration system to remove debris from the working airflow generated by the suction source;
- a suction inlet;
- a dirt container positioned in at least one of the handle, wand or housing;
- a first agitator located on the housing in juxtaposition with a surface to be cleaned; and
- a working air conduit extending from the suction inlet and the dirt container, wherein, when the suction source is active, the suction source draws debris through the suction inlet, along the working air conduit for collection into the dirt container, wherein a portion of the working air conduit forms an intermediate collection chamber, the intermediate collection chamber being removable from a stored position in the housing, wherein when the suction source is not active, manual movement of the housing over the surface being cleaned rotates the first agitator and transports debris removed from the surface being cleaned by the first agitator into the suction inlet and into the intermediate collection chamber.

13. The surface cleaning apparatus of claim 12, further comprising a second agitator located on the housing in juxtaposition with the surface to be cleaned, the second agitator adapted to be dampened.

14. The surface cleaning apparatus of claim 13 wherein the user can operate the surface cleaning apparatus to provide a manual damp mopping by manipulating the surface cleaning apparatus over the surface being cleaned without activating the suction source.

15. The surface cleaning apparatus of claim 13 wherein the second agitator can be dampened with at least one of water, detergent, or a liquid composition.

16. The surface cleaning apparatus of claim 13 wherein the second agitator is a removable sheet or a removable pad.

17. The surface cleaning apparatus of claim 16 wherein the removable sheet or the removable pad is pre-moistened with at least one of water, detergent, or other liquid composition.

18. The surface cleaning apparatus of claim 1, wherein the at least one rotatable agitator is at least partially disposed above the dirt inlet ramp.

19. The surface cleaning apparatus of claim 1, wherein the at least one rotatable agitator is at least partially disposed in the dirt path.

20. The surface cleaning apparatus of claim 1, wherein a rotation of the at least one rotatable agitator transports debris removed from the surface being cleaned into the suction inlet.

* * * * *